US008756742B1

(12) United States Patent
Salzman et al.

(10) Patent No.: US 8,756,742 B1
(45) **Date of Patent: *Jun. 24, 2014**

(54) GOLF TOWEL

(71) Applicant: Brightspot Solutions, LLC, Longmont, CO (US)

(72) Inventors: Scott Salzman, Longmont, CO (US); Brett Salzman, Longmont, CO (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/892,361

(22) Filed: May 13, 2013

Related U.S. Application Data

(63) Continuation of application No. 12/951,261, filed on Nov. 22, 2010, now Pat. No. 8,516,643.

(60) Provisional application No. 61/285,261, filed on Dec. 10, 2009.

(51) Int. Cl.
*A47L 13/12* (2006.01)

(52) U.S. Cl.
USPC ..... 15/118; 15/209.1; 15/210.1

(58) Field of Classification Search
USPC ..... 15/118, 209.1, 210.1
See application file for complete search history.

(56) References Cited

U.S. PATENT DOCUMENTS

| | | | |
|---|---|---|---|
| 4,912,800 | A | 4/1990 | Zeltner |
| 5,075,918 | A | 12/1991 | Zeltner et al. |
| 5,147,703 | A | 9/1992 | Provost et al. |
| D330,140 | S | 10/1992 | Lerner |
| 5,770,284 | A | 6/1998 | Logemann |
| 6,019,854 | A | 2/2000 | Thomas |

OTHER PUBLICATIONS

Final Office Action, Mar. 20, 2008, U.S. Appl. No. 11/380,267.
Non-Final Office Action, Sep. 14, 2007, U.S. Appl. No. 11/380,267.

*Primary Examiner* — Randall Chin
(74) *Attorney, Agent, or Firm* — Maxey Law Offices PLLC; Stephen Lewellyn

(57) ABSTRACT

A sports towel constructed in the form of bag having an interior surface and an exterior surface wherein soil on the interior surface is prevented from transfer to the exterior surface is provided. The towel includes a bag-shaped body constructed of a fabric material. The body has opposing first and second ends and a continuous peripheral wall extending between said first and said second ends. The first end being closed and together with said peripheral wall defining an interior space within said body. The second end being open and providing access into said interior space. The peripheral wall including an interior surface that includes two areas of dissimilar surfaces.

9 Claims, 3 Drawing Sheets

GOLF TOWEL

CROSS-REFERENCE TO RELATED APPLICATIONS

This application is a continuation of U.S. application Ser. No. 12/951,261, entitled "Golf Towel," filed Nov. 22, 2010, now U.S. Pat. No. 8,516,643, which claims the benefit of U.S. Provisional Application No. 61/285,261, filed Dec. 10, 2009, each of which are incorporated by reference herein in their entirety.

FIELD OF THE INVENTION

The present invention relates generally to towels employed by golfers to clean their person and equipment such as golf clubs, golf balls and the like, and more particularly, to a towel that provides separate cleaning surfaces.

BACKGROUND OF THE INVENTION

Golfers generally carry towels to clean their equipment during and after play. During play the equipment has a tendency to become heavily soiled requiring cleaning to continue use. The equipment is generally wiped clean with a towel transferring the soil to the towel, and thus soiling the towel. During play a golfer may also have the need to wipe himself/herself free of sweat and/or dirt, and must carry a second towel for this purpose or be forced to use the equipment towel. It is not desirable to wipe oneself with a dirty towel used to clean equipment, and further, it is cumbersome to carry two separate towels for each purpose. Therefore, there exists a need to provide a single towel having a cleaning surface for cleaning equipment and another cleaning surface for cleaning oneself where soil cannot be easily transferred between the cleaning surfaces during normal use.

SUMMARY OF THE INVENTION

The present invention is a golf towel that is constructed in the form of a bag. The interior surface of the bag shaped towel provides cleaning surfaces that suitable for cleaning soiled equipment where the removed dirt remains trapped or contained within the interior of the bag shaped towel. The exterior surface of the bag shaped towel provides a cleaning surface suitable for wiping ones face and/or hands. The interior cleaning surfaces include a cleaning surface of a textured fabric material that is suitable for cleaning the grooves of a golf club.

In general, in one aspect, the towel includes a bag-shaped body constructed of a fabric material. The body has opposing first and second ends and a continuous peripheral wall extending between said first and said second ends. The first end being closed and together with said peripheral wall defining an interior space within said body. The second end being open and providing access into said interior space. The peripheral wall including an interior surface that includes two areas of dissimilar surfaces.

In general, in another aspect, a first area of the two areas of dissimilar surfaces is covered by a plurality of stiff loop portions and a second area of the two areas of dissimilar surfaces is free of said plurality of stiff loop portions.

In general, in another aspect, the first area is provided by a first fabric panel and the second area is provided by at lest a second fabric panel, and wherein the first and the second fabric panels are sewn together and at least partially form the peripheral wall.

There has thus been outlined, rather broadly, the more important features of the invention in order that the detailed description thereof that follows may be better understood and in order that the present contribution to the art may be better appreciated.

Numerous objects, features and advantages of the present invention will be readily apparent to those of ordinary skill in the art upon a reading of the following detailed description of presently preferred, but nonetheless illustrative, embodiments of the present invention when taken in conjunction with the accompanying drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The accompanying drawings, which are included to provide further understanding of the invention and are incorporated in and constitute a part of this specification, illustrate preferred embodiments of the invention and together with the description serve to explain the principles of the invention, in which.

DETAILED DESCRIPTION OF THE INVENTION

Figure 1:
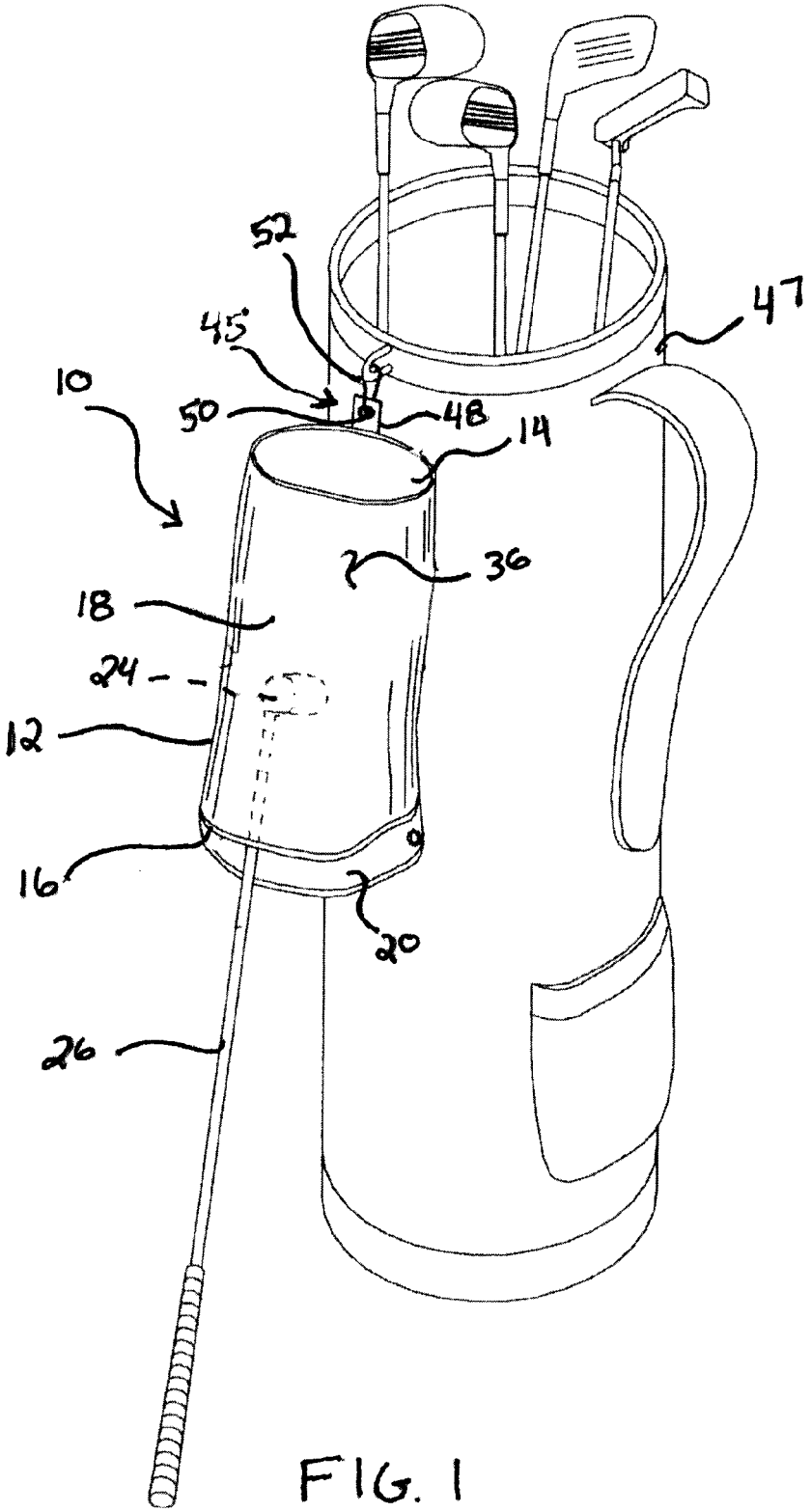
FIG. 1 is a perspective view of a golf towel constructed in accordance with the principles of the present invention shown in use attached to a golf bag and with a golf club inserted into the towel for cleaning on an interiorly located cleaning surface.
Figure 2:
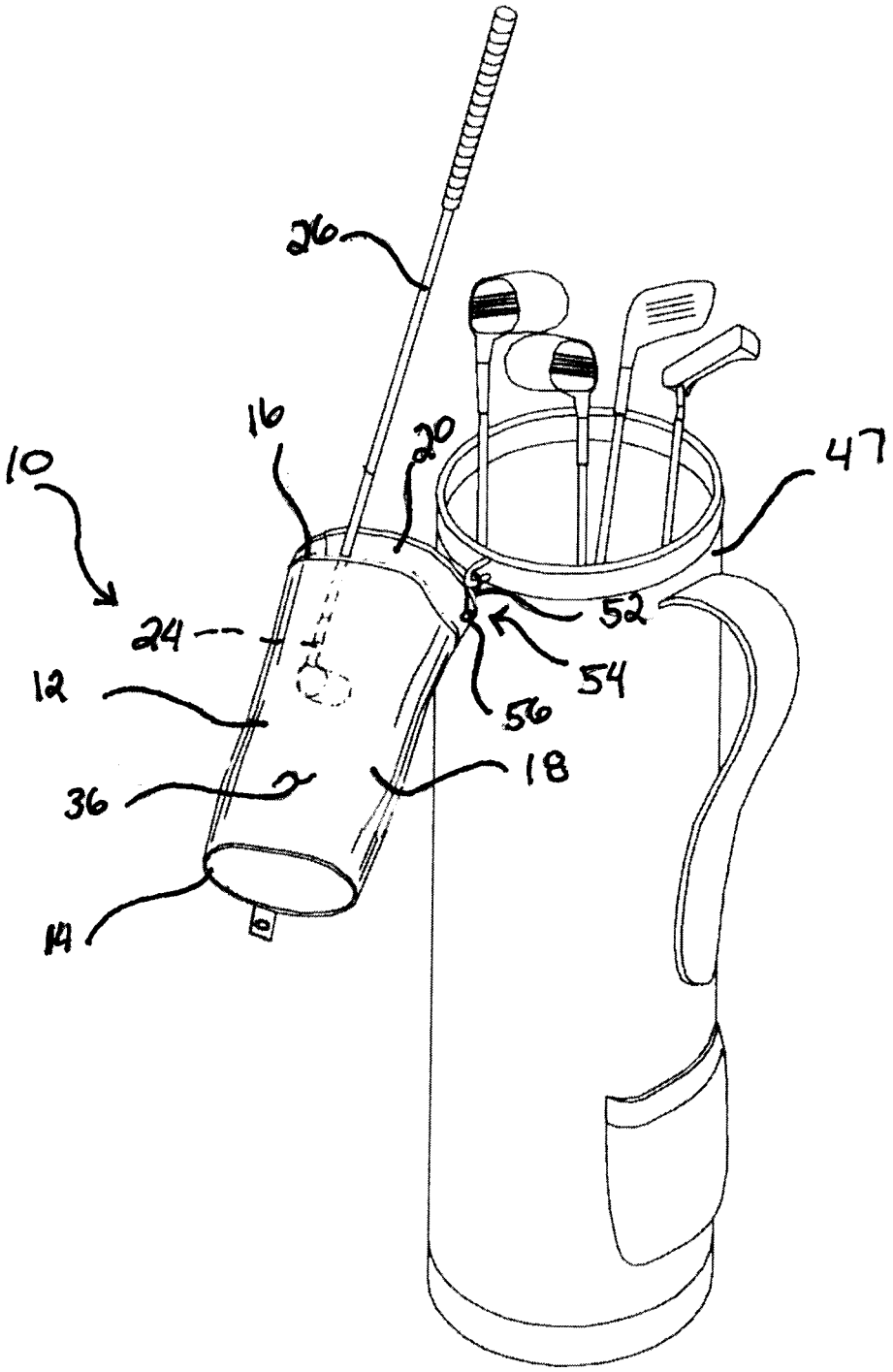
FIG. 2 is a perspective of the golf towel of FIG. 1 in an alternate configuration with a golf club inserted into the towel for cleaning on an interiorly located cleaning surface.
Figure 3:
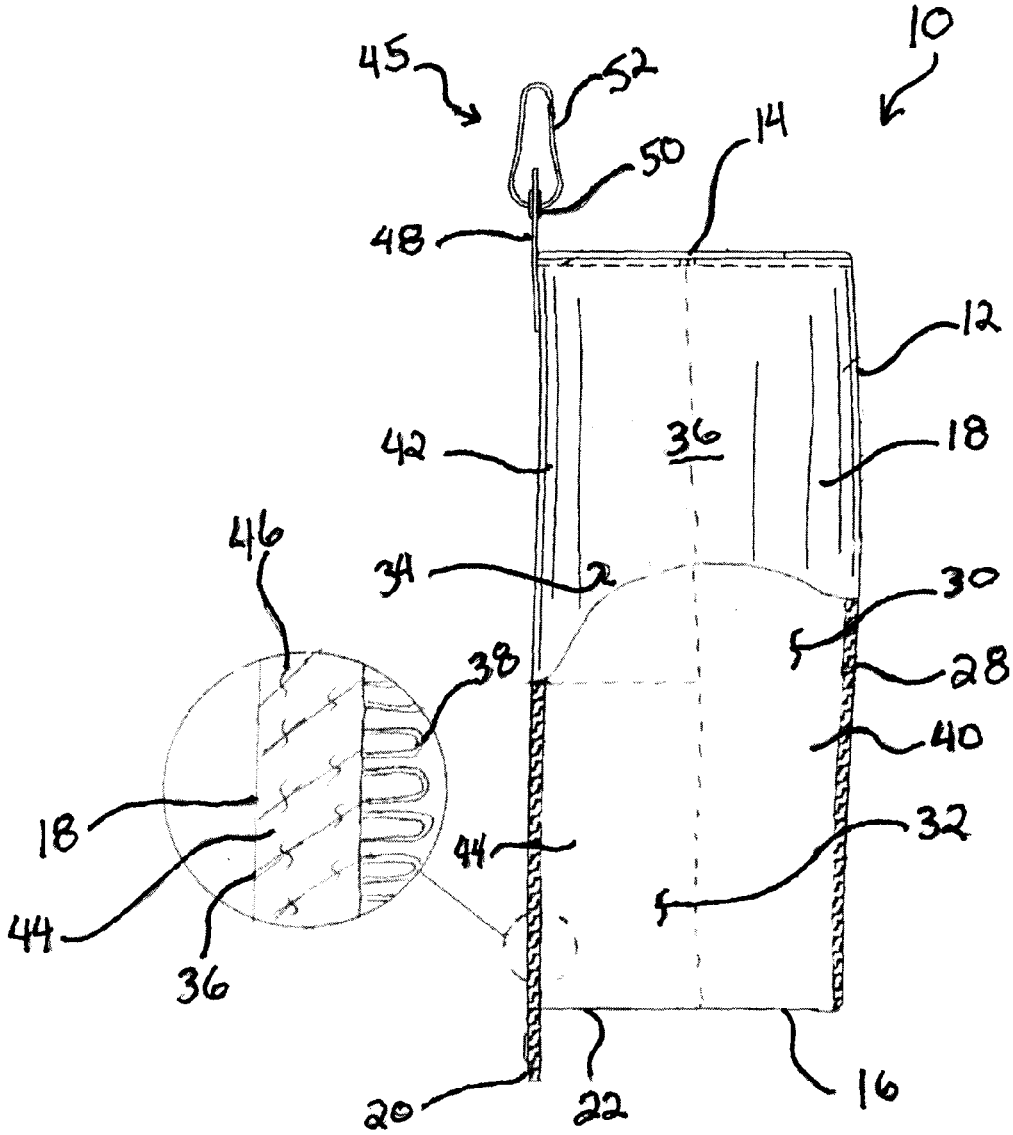
FIG. 3 is a partial cross-sectional view of the golf towel of claim illustrating multiple interiorly located cleaning surfaces.

Referring now to FIGS. 1-3 of the drawings, reference numeral 10 generally designates a golf towel having an improved construction that provides three separate cleaning surfaces to meet the very different cleaning needs of a golfer.

The golf towel 10 includes a body 12 that is bag-shaped and has a closed end 14, and opposed open end 16. The body 12 has a generally cylindrically-shaped continuous peripheral wall 18 that extends between ends 14 and 16. Peripheral wall 18 can be constructed from a single piece of fabric material or from several sections of fabric material sewn together to form a continuous construction between ends 14 and 16. A tab or flap 20 extends from peripheral edge 22 of open end 16 and serves to guide a club head 24 of a golf club 26 into the body 12.

The interior surface 28 of the peripheral wall 18 of the body 12 is divided into two separate cleaning surfaces, including a first cleaning surface 30 and a second cleaning surface 32. The exterior surface 34 of the peripheral wall 18 provides a third cleaning surface 36. The first cleaning surface 30 and exterior cleaning surface 36 are provided by a first fabric material, such a micro-fiber fabric material. The cleaning surface 32 is provided by a textured fabric material. The textured fabric material may include a plurality of stiff loop portions 38. Loop portions 38 provide a coarse surface suitable for cleaning the grooves of a golf club head. Loops portions 38 may be of film yarn, and formed by various methods, including needling the film yarn in to base fabric, knitting or weaving. Other suitable methods are possible. The lower cleaning surface 32 may extend across the flap 20.

The first cleaning surface 30 is intended to be a light duty club cleaning surface to generally wipe clean a dirty or wet club head. The second cleaning surface 32 is intended to be a heavy duty cleaning surface to clean the grooves of a club head. The third cleaning surface 36 is intended to be a personal cleaning surface for wiping ones face and/or hands, club grips, gloves etc. Because the first and second cleaning surfaces 30 and 32 are positioned interiorly of the body 12 and are separated by the peripheral wall 18 from the third cleaning surface 36, the third cleaning surface remains free from being soiled by the first and second cleaning surfaces. In other words, the dirt removed from the golf club or other golf equipment by the first and second cleaning surfaces 30 and 32 is trapped within the body 12 and is prevented from being transferred to the third cleaning surface 36, thereby preserving the second cleaning surface for use in cleaning the golfer.

In an aspect, the peripheral wall 18 of the body 12 can be constructed of three panels of fabric material 40, 42 and 44 that are sewn together along respective edges to construct the peripheral wall. The first panel 40 forms a complete one-half, semi-cylindrical vertical forward section of the peripheral wall 18. The second and third panels 42 and 44 together form a complete one-half semi-cylindrical vertical rearward section of the peripheral wall 18 as depicted and best seen in FIG. 3, where the dashed lines indicate the seams between the panels. Further, as can be seen, the second panel 42 forms an upper horizontal portion, and the third panel 44 forms a lower horizontal portion of the rearward section of the peripheral wall 18. The first and second panels 40 and 42 comprise a high absorbent material, such as a micro-fiber. Essentially, the third panel 44 comprises a fabric 46 constructed with known methods, such as weaving, knitting or the like, to include a surface with stiff loops 38 and an opposed surface without loops. Loops 38 are sufficiently stiff to permit the loops to clean dirt and debris from the grooves of striking face of a golf club.

In an example, fabric 46 is constructed with micro-fiber yarn, and mono film yarn and may include a background yarn to maintain the structure of the fabric 46, which are interwoven using known methods. The micro-fiber yarn may be a Polyester 80% & Polyamide (Nylon) 20% yarn. The mono film yarn may be polyester mono film yarn. The background yarn may be a polyester yarn.

With reference to FIG. 1, a first attachment means 45 for releasably attaching the towel 10 to a golf bag 47 is attached approximate the first end 14 of the body 12. The first attachment means 45 releasably attaches the towel 10 to the golf bag 47 such that open end 16 of the body 12 generally faces downwardly. In this configuration, golfing equipment, such as golf club 26 is required to be inserted into the body 12 in a general upwardly direction towards end 14. As an example, the first attachment means 45 includes a tab 48 that is attached at one end to the end 14 of the body 12 and includes a grommet 50 at an opposite end through which a clip 52 is positioned. The clip 52 is used to releasably attach the towel 10 to common attachment points on the golf bag 47 or other equipment, such as a golf cart, belt, etc.

With reference to FIG. 2, a second attachment means 54 for releasably attaching the towel 10 to a golf bag 47 is attached approximate end 16 of the body 12. The second attachment means 54 releasably attached the towel 10 to the golf bag 47 such that end 16 of the body 12 generally faces upwardly. In this configuration, golfing equipment, such as golf club 26 is required to be inserted into the body 12 in a generally downwardly direction towards end 14. As an example, the second attachment means 54 is shown having a clip 52 passed through a grommet hole 56 formed through flap 20. The clip 52 is used to releasably attach the towel 10 to common attachment points on the golf bag 47 or other equipment, such as a golf cart.

A number of embodiments of the present invention have been described. Nevertheless, it will be understood that various modifications may be made without departing from the spirit and scope of the invention.

The invention claimed is:

1. A towel, comprising:

a bag-shaped body constructed of a fabric material, said body including opposed first and second ends and a continuous peripheral wall extending between said first and said second ends, said first end being closed and together with said peripheral wall defining an interior space within said body, said second end being open and providing access into said interior space;

said peripheral wall including an interior surface that includes two areas of dissimilar surfaces;

wherein a first area of said two areas of dissimilar surfaces is covered by a plurality of stiff loop yarn portions that are formed integral with said peripheral wall and a second area of said two areas of dissimilar surfaces is free of said plurality of stiff loop portions; and wherein said first area extends completely along a one-half semi-cylindrical portion of said interior surface about said open end.

2. The towel of claim 1, wherein said first area is provided by a first fabric panel and said second area is provided by at least a second fabric panel, and wherein said first and said second fabric panels are sewn together and at least partially form said peripheral wall.

3. The towel of claim 1, wherein said body further includes a flap portion extending from a peripheral edge of said open end.

4. The towel of claim 3, further comprising:

a first attachment means for releasably attaching said body to a support, said first attachment means being located approximate said first end;

a second attachment means for releasably attaching said body to the support, said second attachment means being located at said flap portion, whereby the body can either be attached to the support by said first attachment means such that said second end is facing downwardly or be attached to the support by said second attachment means such that said second end is facing upwardly.

5. The towel of claim 1, wherein said peripheral wall is constructed of three separate fabric panels sewn together forming a cylindrically-shaped continuous wall, each of said fabric panels having an exterior surface that collectively provide an exterior surface of said peripheral wall, an interior surface of a first fabric panel of said three separate fabric panels provides said first area of said two areas of dissimilar surfaces and an interior surface of a second fabric panel of said three separate fabric panels provides said second area of said two areas of dissimilar surfaces.

6. The towel of claim 5, wherein said body further includes a flap portion extending from a peripheral edge of said open end.

7. The towel of claim 6, further comprising:

a first attachment means for releasably attaching said body to a support, said first attachment means being located approximate said first end;

a second attachment means for releasably attaching said body to the support, said second attachment means being located at said flap portion, whereby the body can either be attached to the support by said first attachment means such that said second end is facing downwardly or be attached to the support by said second attachment means such that said second end is facing upwardly.

8. The towel of claim 1, wherein said plurality of stiff loop yarn portions do not form part of a closure operating to close said second open end.

9. A towel comprising:

a bag-shaped body constructed of a fabric material, said body including opposed first and second ends and a continuous peripheral wall extending between said first and said second ends, said first end being closed and together with said peripheral wall defining an interior space within said body, said second end being open and providing access into said interior space;

said peripheral wall including an interior surface that includes two areas of dissimilar surfaces;

wherein a first area of said two areas of dissimilar surfaces is covered by a plurality of stiff loop yarn portions and a second area of said two areas of dissimilar surfaces is free of said plurality of stiff loop portions; and wherein said body further includes a flap portion extending from a peripheral edge of said open end.

* * * * *